United States Patent [19]

Hampson

[11] 4,026,372

[45] May 31, 1977

[54] DRILL BITS

[75] Inventor: John Raymond Hampson, Bolton, England

[73] Assignee: Padley & Venables Limited, Great Britain

[22] Filed: May 17, 1976

[21] Appl. No.: 686,820

Related U.S. Application Data

[63] Continuation of Ser. No. 552,886, Feb. 25, 1975, abandoned.

[30] Foreign Application Priority Data

Mar. 21, 1974 United Kingdom ..... 12600/74

[52] U.S. Cl. ..... 175/410; 175/419

[51] Int. Cl.[2] ..... E21C 13/01

[58] Field of Search ..... 175/410, 415, 419, 420

[56] References Cited

UNITED STATES PATENTS 2,179,689 11/1939 Earuheart ..... 175/419

2,800,303 7/1957 Dick ..... 175/415

3,163,245 12/1964 York ..... 175/410

FOREIGN PATENTS OR APPLICATIONS 1,228,941 9/1960 France ..... 175/410

*Primary Examiner*—James A. Leppink

*Attorney, Agent, or Firm*—Stevens, Davis, Miller & Mosher

[57] ABSTRACT

Rotary percussive drill bits comprising a body having a longitudinal axis, side face, end face, and cutting inserts, arranged such that during rotary percussive drilling wear tends to take place over a clearance face of the insert thus preserving the leading cutting edge of the insert, wherein the inserts have a substantially flat leading face which projects axially fowardly of the body end face to communicate at the leading cutting edge with a clearance face, with the leading cutting edge extending radially outwardly beyond the side face of the bit body.

31 Claims, 17 Drawing Figures

DRILL BITS

This is a continuation of application Ser. No. 552,886 filed Feb. 25, 1975, now abandoned.

This invention relates to drill bits of the type commonly used in rotary percussive drilling operations, and is particularly concerned with the form and arrangement of cutting inserts thereof.

Percussive drilling is well known in the art, whereby the breaking of the rock being drilled is effected by inducing fracture of the rock between identations (produced by impact of the drill bit) at positions sufficiently close to each other. Broken rock, or detritus, may then be removed, in well known manner by, for instance, a jet of high pressure fluid being passed through an end or side face of the drill bit.

Improvements to percussive drilling include rotatably indexing the drill bit, and the drill string to which the drill bit is attached, through a predetermined angle between sequential impacts. Rotation of the drill bit is preferred since it generally enables fewer and/or smaller inserts to be carried on the drill bit than on a drill bit which is used non-rotatably. It has been general practice in the art to provide machines which embody mechanically constructed indexed rotation. This requires cutting inserts which are designed primarily to withstand the stresses of impact since rotation normally only occurs with the drill bit clear of the rock face.

Recently it has become common practice to utilize systems which provide independent rotation to the drill bit so that it is continuously rotated during operation while simultaneously being subjected to percussive blows to induce stress in the rock and the present invention aims at providing a drill bit which is suitable for use under these conditions.

According to the present invention there is provided a rotary percussive drill bit comprising a body having a longitudinal axis and an end face; cutting inserts mounted in the body and projecting axially forwardly from the end face; each insert having a substantially flat leading face which lies substantially in a plane extending parallel to the longitudinal axis to provide a substantially zero rake angle, all such leading faces being similarly oriented to face towards the intended direction of rotation of the bit; and wherein each said leading face projects axially forwardly of the body end face and communicates at a cutting edge with a clearance face of its insert, which clearance face extends substantially transversely of the bit, the arrangement being such that during rotary percussive drilling wear tends to take place over the clearance face and thus the cutting edge tends to be preserved. Preferably the cutting inserts are of elongate form and are mounted so that their major dimensions extend substantially radially of the body.

By the expressions "forwardly" and "forward direction" as used throughout this Specification we refer to the proposed direction of penetration of the bit into the material being drilled. Further, by the statement that "the leading face lies substantially in a plane extending parallel to the longitudinal axis" we mean that the leading face does not deviate more than 5° (and preferably not more than 2° on either side of such a longitudinal plane which includes the cutting edge.

It is believed that the drill bit of the present invention will provide improved break-up of rock during use by virtue of the rotary force which fragments the rock subsequent to stress inducement in the rock by indentation on impact.

It is preferred that the clearance faces are flat to provide straight cutting edges. It is also preferred to make a first angle of the insert, between the leading face and the clearance face, acute, and we have found that for optimum efficiency such first angle is desirably in the range 80° to 87°. Test drillings have indicated that an advantage which may be derived from a cutting insert having the generally aforementioned geometry is that the first angle of the insert between its leading face and its clearance face may substantially be maintained during use of the bit. In this way it is hoped that the cutting edge of the insert may be retained so that it will not require re-sharpening throughout its useful life.

Extending from the side of the clearance face remote from the leading face of each insert, there may be provided a trailing face, which latter face will, upon its notional extension, preferably make a second acute angle with the leading face (when the latter is notionally extended). Usually the second acute angle will be less than the first acute angle and preferably lies in the range 50°to 80°.

Test drillings have indicated that a drill bit in accordance with the present invention and having the preferred characteristics as above mentioned is less inclined to bounce away from the face of the rock between percussive impact blows when used in the intended manner as compared with the conventional forms of drill bits. This is believed to be a most desirable feature since the alleviation of drill bit bounce allows the cutting edges to remain clos to the material being cut, which may help to provide a greater chip or particle size, to alleviate the amount of dust produced and to provide improved evacuation of detritus from the bottom of the drilled hole. This latter feature is important if successful drilling is to be achieved since any rock chips which remain at the bottom of the drilled hole can act as a cushion to impact and thereby dissipate the input energy of the impact.

In a drill bit of the present invention the leading face of the insert faces towards the intended direction of rotation of the drill bit, and extends forwardly of the end face of the bit body to a distance, which can be related to the nature of the rock or minerals to be drilled; this distance will generally lie within the range 0.1 to 0.5 cms.

Preferably, but not essentially, the bit inserts are made of tungsten carbide, or other such hard material as is well known in the art. Further, the inserts may be secured in appropriate channels or other seatings in the bit by means well known in the art, for example by use of brazing or body metal shrinking techniques. Usually the inserts will be of elongate form and extend generally radially over the bit end face, for example, any number (usually 2, 3, 4, 5 or 6) of elongate and radially extending inserts may be provided which are peripherally spaced around the axis of the bit dependent upon particular requirements of a drilling operation. However the bit of the present invention may have inserts of a shape and location other than elongate and radial as above mentioned, for example, the inserts may be of non-elongate form such as circular or polygonal section when viewed axially of the bit, the appropriate leading and clearance faces being provided on such non-elongate forms.

Several embodiments of drill bits constructed in accordance with the present invention will now be described, by way of example only, and with reference to the accompanying diagrammatic drawings, in which.

Where possible throughout the following diescription the same parts and members have been accorded the same reference numerals (but with different suffixes for the different embodiments).

Figure 1:
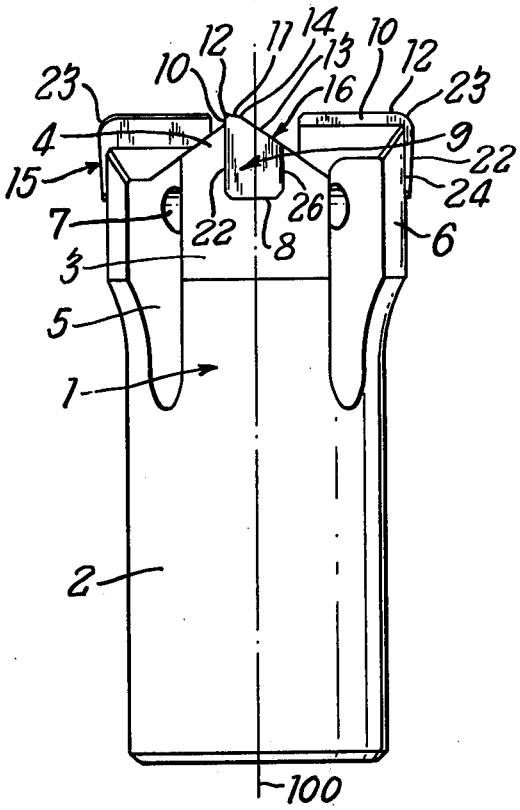
FIG. 1 shows a side elevation of a first embodiment of the drill bit.

The drill bit shown generally at 1, in FIG. 1, comprises a body having a hollow cylindrical shank 2, a head 3 and a longitudinal axis 100. The head 3 has and end face shown generally at 4. Four flushing grooves 5 are provided in the head 3, these being disposed in conventional manner at regular angular intervals around the axis 100 of the body, and extending longitudinally part of the length thereof. The grooves 5 partially define radially extending wing portions 6 in the head and may have openings 7 therein through which flushing fluid can be passed from the hollow shank to aid removal of detritus from the rock face during use of the drill bit.

On the end face 4 of each wing portion 6 is provided a radially extending channel 8 in which is located and secured a cutting insert 9 of hard material such as tungsten carbide. Each insert 9 has a leading face 10 which faces towards the intended direction of rotation of the drill bit; a clearance face 11 which makes an acute angle, and communicates, with the leading face 10 at a cutting edge 12; and a trailing face 13 which communicates, at an edge 14, with the clearance face 11 and is on the side of the face 11 remote from the cutting edge 12. The leading face 10 of each insert 9 extends forwardly beyond the forward-most point of the end face 4 of each wing portion 6 and lies in a plane which is parallel wiht the longitudinal axis 100 of the bit. Further, each insert 9 and its leading face 10 extends laterally outwardly at 15 beyond the side face of the head 3 of the bit body 2.

It will be seen from FIG. 1 that the cutting edges 12 of the inserts 9 all lie in a common plane which is perpendicular to the longitudinal axis of the bit, and while this feature is preferable it is by no means essential.

As forementioned, the drill bit shown in FIG. 1 is generally hollow along the longitudinal axis 100 so that, in use, flushing fluid may be passed down a drill string (not shown) to which the drill bit is attached (by an internal screw or rope thread in the shank 2), through the drill bit to emerge by way of the openings 7 in the head 3. An opening 16 may be provided in and centrally of the end face 4 (in addition or as an alternative to the openings 7) through which flusing fluid may be passed axially towards the rock face.

Figure 2:
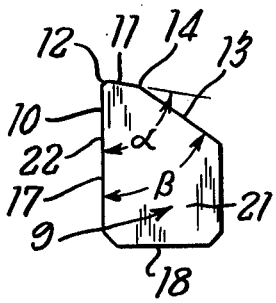
FIG. 2 shows a front elevation of a hard material insert used in the bit of FIG. 1.
Figure 3:
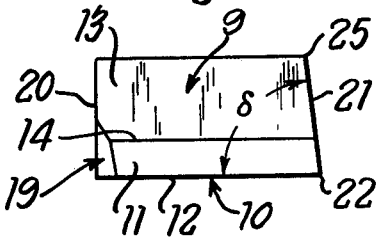
FIG. 3 is a plan view of the insert in FIG. 2.
Figure 4:
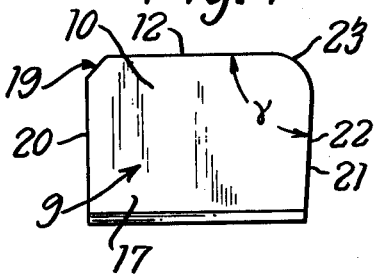
FIG. 4 is a side elevation of the insert in FIG. 2.

As is best illustrated in FIGS. 2 to 4, each cutting insert 9 has its flat leading face 10 constituting part of a substantially full side face 17 of the insert 9. The leading face 10 is also arranged to have a substantially zero rake angle - when the insert is mounted and secured (usually by brazing or shrinkage techniques) in a channel 8 - so that all the faces 10 lie in planes which are substantially parallel to the longitudinal axis 100 of the drill bit. In the present embodiments the clearance face 11 makes an angle $\alpha$ with the leading face 10 of its insert and the angle $\alpha$ will generally lie in the range 80° to 87°, but is preferably 83°. Further the trailing face 13 makes an angle $\beta$ with the leading face 10 of its insert and the angle $\beta$ will generally lie in the range 50° to 80°, but is preferably 55°. This trailing face 13 extends to the end face 4 and the latter is shaped locally to present a substantially smooth surface with the trailing face.

As also shown in FIG. 2, cutting edge 12 may be slightly rounded or beveled.

From FIGS. 3 and 4 it will be seen that the cutting edge 12 of the insert 9 is effectively shortened by a bevel 19 so that the cutting edge 12 does not extend the full length of the leading face 10. The bevel 19 is located at the radially inner end of its cutting edge in the drill bit (that is by effectively removing the corner which would otherwise be formed at the junction of the inner side face 20 with faces 10 and 11 of the insert) and is intended to alleviate the likelihood of the inner end of the cutting edge 12 breaking off during use.

The leading face 10 forms an acute angle $\delta$ with a radially outer side face 21 of the insert 9 (see FIG. 3) to form a longitudinally extending second cutting edge 22 which is located radially outwardly of the side face of the head 3 so that a portion 24 of the leading face extends beyond the side face of the head and a certain amount of clearance cutting for the diameter of the bit head will be provided. The end of the cutting edge 12 remote from the bevel 19 communicates through a bevel or an arcuate edge portion 23 (see FIG. 4) with the second cutting edge 22. The acruate edge portion 23 (or a correspondingly positioned bevel) is intended to alleviate breakage of the insert at the corner which may otherwise be formed at the junction of edges 12 and 22. The cutting edge 12 converges at an acute angle $\gamma$ with the second cutting edge 22 to provide a rearward taper to the edge 22 (see FIG. 1) and this angle $\gamma$ will generally lie in the range 80° to 89°, but is preferably 87° as shown.

Figure 5:
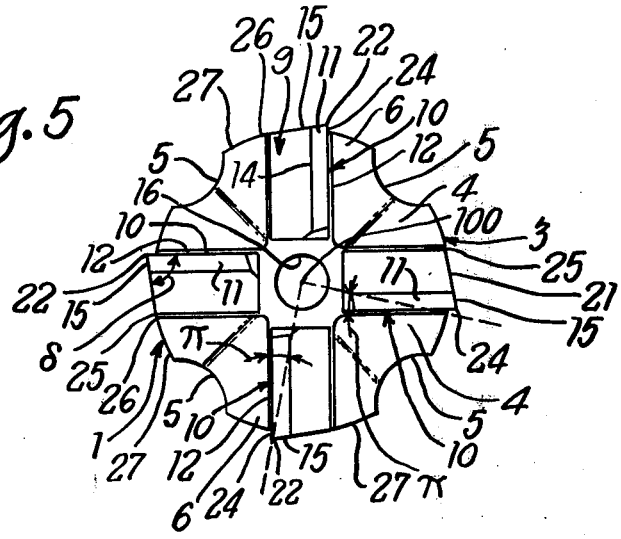
FIG. 5 is a plan view of the drill bit in FIG. 1.

The intended direction of rotation of the bit 1 as shown in FIG. 5 is clockwise and consequently it will be seen that the leading face 10 of each insert faces the direction of rotation.

While each insert 9 is located to extend radially relative to the axis of the bit 1, from FIG. 5 it will be seen that each leading face 10 lies in a plane which is parallel to the bit axis but which plane does not include the bit axis 100.

Figure 5A:
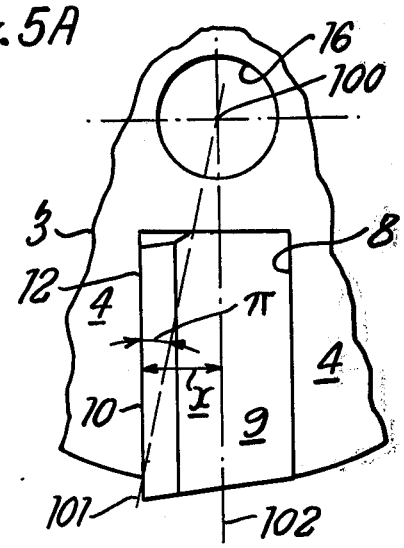
FIG. 5A is a scrap plan view of part of the drill bit in FIG. 5 and illustrates the geometrical positioning of the leading face of an insert relative to the longitudinal axis of the bit.

It will be seen from FIGS. 5 and 5A, especially the latter, that if the radially outer end of a leading face 10 at the position where it notionally intersects the peripheral edge of the face 4 is considered as lying in a notional plane 101 which latter plane is parallel with, and includes, the bit axis 100, then each leading face 10 forms an acute angle $\pi$ with the notional plane 101 so that the radially inner part length of the cutting edge 12 leads the radially outer end of the cutting edge during rotation of the drill bit in the intended direction for drilling. The angle $\pi$ will generally be not greater than 30° and is preferably 5 to 10°. Generally the leading face 10 and associated cutting edge 12 for each insert will extend outwardly beyond the peripheral edge of the end face 4 for clearance cutting; however constructions are envisaged in which the leading faces of one or more inserts do not extend outwardly beyond the peripheral edge as aforementioned and in such constructions the angle $\pi$ will be regarded as the angle formed between the appropriate leading face and the notional plane 101 which passes through the position at which the notional projection of the appropriate leading face notionally intersects the peripheral edge of the end face 4.

Another way in which the geometrical positioning of the leading faces for the inserts shown in FIGS 5 and 5A may be considered is that each leading face 10 is parallel to a notional plane 102 which latter plane is parallel with, and includes, the bit axis 100 and the perpendicular distance between the leading face 10 and plane 102 is $x$ so that the cutting edge 12 leads the notional plane 102 during rotation of the drill bit in the intended direction for drilling. The distance $x$ will generally be not greater than (3.14d 12) and is preferably (3.14d 36) (where "d" is the diameter of the hole to be drilled).

As above mentioned, the edges 22,23 and partially 12 provide clearance cutting during use of the bit. The acute angle $\delta$ between the leading face 10 and the outer side face 21 is arranged (see FIGS. 3 and 5) so that the longitudinal edge 25 of the outer side face 21 remote from the second cutting edge 22 communicates with a corner 26 on a part 27 of the adjacent wing portion 6 whereby the outer side face 21 of each insert and the adjacent part 27 of the wing portion 6 present a substantially smooth surface.

Figure 6:
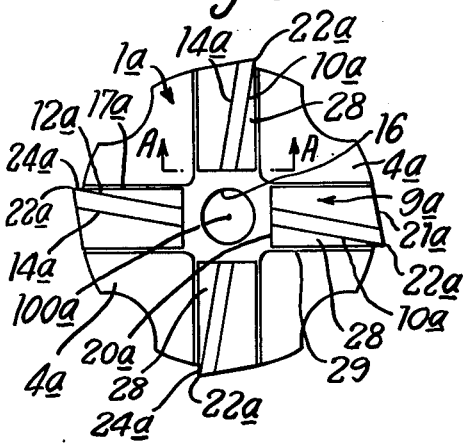
FIG. 6 is a plan view of a second embodiment of the drill bit.
Figure 7:
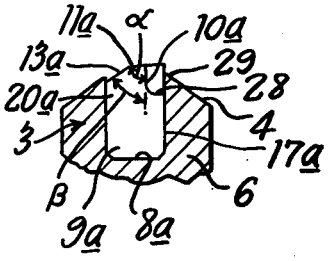
FIG. 7 is a sectional scrap view of the drill bit in FIG. 6, the section being taken on the line A—A of FIG. 6.

In the embodiment of drill bit shown in FIGS. 6 and 7 in which similar parts or members to those shown in FIGS. 1 to 5 have been accorded the same reference numerals having the suffix "*a*", the bit end face **4*a* carries an array of second type bit inserts 9*a*. The leading face 10*a* of each insert 9*a* is obliquely offset in plan with respect to the radial extend of its insert so that the radially outer end of the cutting edge 12*a* is located nearer to the side face 17*a* of the insert than is the radially inner end of the cutting edge and, as shown in FIG. 6, the plane of each leading face 10*a* is parallel to, and includes, the bit axis. The edge 14*a* of each insert 9*a* is also obliquely offset with respect of the radial extent of its insert so that it lies parallel to the edge 12*a*** of its insert.

It may be seen from FIG. 7 that the shape of that part of the insert **9*a*, which is actually located within the channel 8*a* is ow substantially the same shape as the corresponding part of the insert 9*a***.

However the flat leading face **10*a* partially defines a generally triangularly shaped rebate 28 which has its widest part at the radially inner side face 20*a* and is at its narrowest on (that is to say it tapers to meet) the second cutting edge 22*a* (see FIG. 6). The leading face 10*a* in the rebate 28 extends axially below the forward-most point 29 of the end face 4*a* of the drill bit 1*a*. In the insert 9*a*, the angle $\alpha$between the leading face 10*a* and the clearance face 11*a* preferably lies in thv range previously mentioned while the angle $\beta$ between the leading face 10*a* and the trailing face 13*a*** may also lie in the range previously mentioned.

Figure 8:
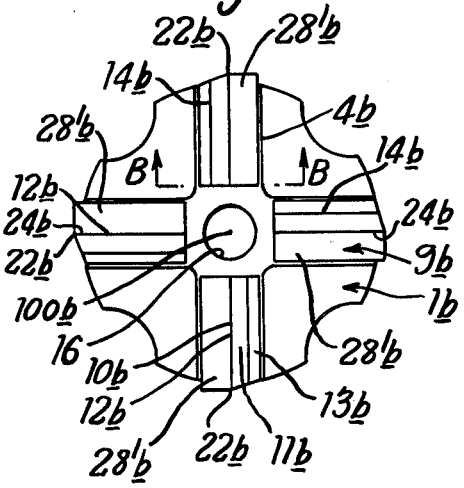
FIG. 8 is a plan view of a third embodiment of the drill bit.
Figure 9:
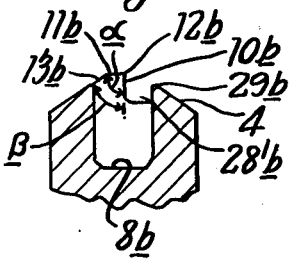
FIG. 9 is a sectional scrap view of the drill bit in FIG. 8, the section being taken on the line B—B of FIG. 8.
Figure 10:
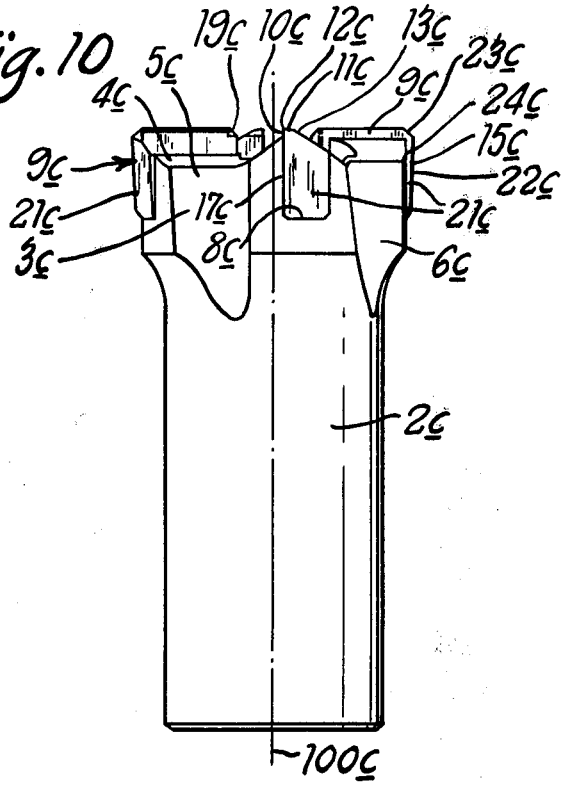
FIG. 10 is a side elevation of a fourth embodiment of the drill bit.

In the embodiment of drill bit shown in FIGS. 8 and 9 in which similar parts or members to those shown in FIGS. 1 to 7 have been accorded the same reference numerals having the suffix "*b*", bit end face **4*b* carries an array of third type inserts 9*b* each having that part which is located in the channel 8*b* of substantially the same shape as the corresponding part on the insert 9 or 9*a***.

The cutting edge **12*b* of each insert 9*b* extends radially of the bit axis while the leading face 10*b* is substantially flat and lies in a plane which is parallel to and includes the bit axis. The leading face 10*b* partially defines a rebate 28*b* which is of uniform section and size along its length. Similarly to the FIG. 7 embodiment the rebate 28*b* extends axially below thv forward-most point 29*b* extends axially below the forward-most point 29*b* of the end face 4*b***.

The angles $\alpha$ and $\beta$ of the inserts in the embodiment of FIGS. 8 and 9 are preferably similar to those angles in the embodiment of FIG. 1.

Figure 11:
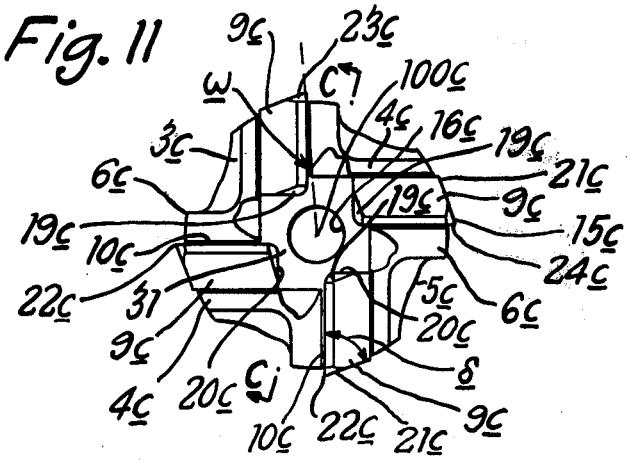
FIG. 11 is a plan view of the drill bit in FIG. 10.
Figure 11A:
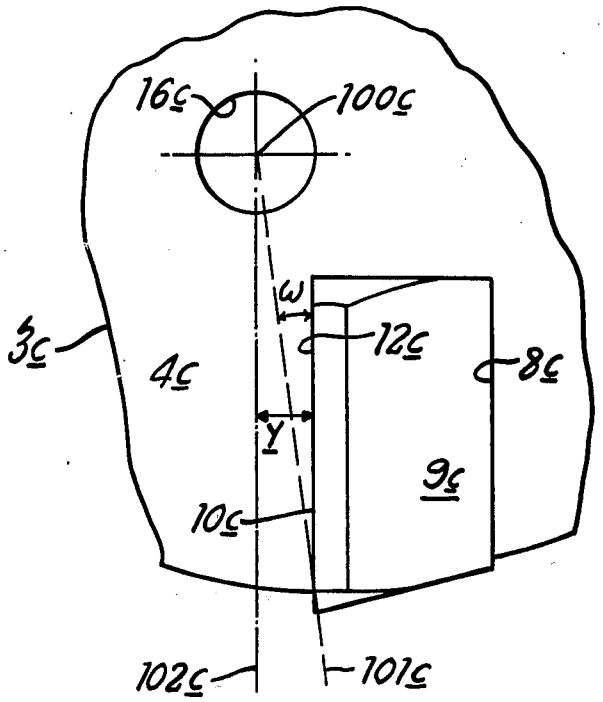
FIG. 11A is a scrap plan view of part of the drill bit in FIG. 11 and illustrates the geometrical positioning of the leading face of an insert relative to the longitudinal axis of the bit.

In the fourth embodiment of drill bit shown in FIGS. 10 to 15 in which similar parts or members to those shown in FIGS. 1 to 9 have been accorded the same reference numerals having the suffix "*c*", the bit end face **4*c* carries an array of four inserts 9*c* of similar shape to the inserts incorporated in the embodiment shown in FIGS. 1 to 5. In this fourth embodiment the inserts 9*c* are located and secured in the channels 8*c* so that their respective leading faces 10*c* are located in planes which are parallel with, but do not include, the longitudinal axis 100*c* of the bit. As will be seen in FIGS. 11 and 11A, particularly the latter, if the radially outer end of a leading face 10*c* at thv position where it notionally intersects the peripheral edge of thv end face 4*c* is considered as lying in a notional plane 10*c* (which latter plane is parallel with, and includes, the bit axis 100*c*) then each leading face 10*c* forms an acute angle $\Omega$ with the notional plane 101*c* so that thv radially outer end of the cutting edge 12*c* leads the radially inner part length of the cutting edge during rotation of the drill bit in the intended direction for drilling. The angle $\omega$ will generally be not greater than 30° and is preferably 5 to 10°. In a similar manner to the discussion with reference to FIG. 5A, if the leading faces 10*c* of one or more inserts do not extend outwardly beyond the peripheral edge of the end face 4*c* then the angle $\Omega$ will be regarded as the angle formed between thv appropriate leading face and the notional plane 10*c* which passes through the position at which the notional projection of the appropriate leading face notionally intersects the peripheral edge of the end face 4c. Another way in which the geometrical positioning of the leading faces 10c for the inserts shown in FIGS. 11 and 11A may be considered is that each leading face 10c is parallel to a notional plane 102c which latter plane is parallel with, and includes, the bit axis 100c and the perpendicular distance between the leading face 10c and plane 102c** is "*y*" so that the cutting edge 12c trails the notional plane 102c during rotation of the drill bit in the intended direction for drilling. The distance *y* will generally be not greater than (3.14d 12) and is preferably (3.14d 36) (where "*d*" is the diameter of the hole to be drilled).

The above described geometrical position of the inserts 9c in the fourth embodiment is believed to be particularly advantageous in so far as it tends to alleviate the shear load which is imparted to the inserts 9c during use of the drill bit as compared with the earlier described embodiments. In addition, the possible locations of the inserts 9c in the end face 4c to provide the aforementioned geometrical configuration is believed to provide improved detritus flow from the hole 16c which emerges centrally of the bit end face 4c.

Figure 12:
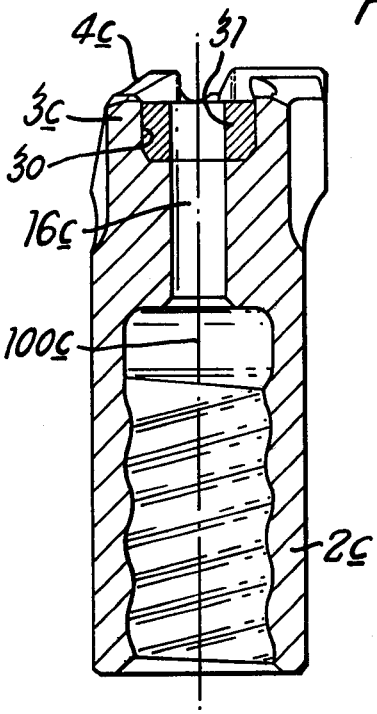
FIG. 12 is a section taken on the line C—C of the drill bit in FIG. 11.
Figure 13:
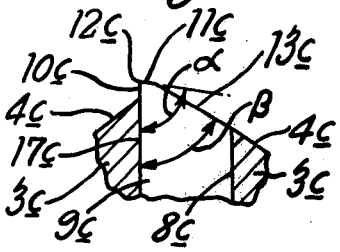
FIG. 13 is a side elevation of part of an insert in the drill bit of FIG. 10.
Figure 14:
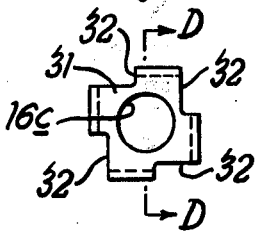
FIGS. 14 and 15 illustrates a center filling piece incorporated in the drill bit body, the former FIGURE is a plan view of the filling piece and the latter FIGURE is a section taken on the line D—D of FIG. 14.
Figure 15:
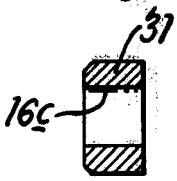

To faciliate manufacture of the drill bit in the embodiment of FIGS. 10 to 15 the head 3c is counterbored (or otherwise formed with a cavity) at 30 along the central hole 16c (see FIG. 12). This cavity 30 opens into end face 4c and permits run-out of a cutting tool during machining of the channels 8c in which are to be located the cutting inserts 9c. After machining of the channels 8c a center filling piece 31 is located in the cavity 30 as shown in FIG. 12. This piece 31 (see FIGS. 14 and 15) has a central aperture which provides continuation for the hole 16c and an external profile which substantially corresponds to that of the cavity 30 except for four recesses 32 its longitudinal side wall. These recesses 32 are located to correspond with the channels 8c so that when the cutting inserts 9c are positioned in their respective channels the radially inner ends of such inserts are received within the respective recesses 32. After location of the center filling piece 31 and inserts 9c as above mentioned these components are secured by brazing to the bit body.

In the embodiment of FIGS. 10 to 15, preferably, the angle $\alpha$is substantially 81°, the angle $\beta$ substantially 60°, and the angle $\delta$ is substantially 70°.

It will be noted that all of the parts of the inserts 9, 9a, 9b and 9c which are located in the respective channels 8 to 8c are of substantially the same shape and may be of similar dimensions for bits of similar size. For this reason it is possible for the inserts 9 to 9c to be interchanged for mounting on the body. Further, it is not essential to the present invention to have only one type of the four different inserts in the drill bit at any one time and if required a combination of different types of inserts may be employed.

It is believed that an important feature of the present invention is the geometrical relationship between the flat leading face 10 and the clearance face 11 and the positioning of the cutting edge 12. During use of the drill bits are above described and illustrated with intermittent percussive blows being imparted to them and with intermittent or constant rotation of the bits, it is believed that the engagement of the cutting edges 12 with the rock face induces stress in the rock on impact and rotation of the bit causes rock to be broken away over the leading faces 10. Further the geometrical form and angular relationship between the faces 10 and 11 of the respective inserts has been found to provide a self-sharpening effect which maintains the cutting edges 12 during wear of the inserts and end face 4 (particularly the forward-most points 29). Similarly the geometrical form and angular relationship between the leading faces 10 and outer side faces 21 of the respective inserts has been found to provide a self-sharpening effect which maintains the second cutting edges 22 during wear of the inserts and bit body.

It is to be realized that while the drill bits discussed in the preferred embodiments have cutting inserts disposed in the cross bit configuration such an arrangement is not essential to the present invention and different forms of cutting edge distribution can be used requiring either four or a different number of cutting inserts. Further, although the inserts in each embodiment are shown extending to the peripheral edge of the end face 4c such an arrangement, although generally incorporated to provide clearance cutting, is not essential for each insert and, for example, one or more discrete inserts constructed in accordance with the invention may be located within the end face of the drill bit at positions remote from the peripheral edge of the end face.

Test drillings have shown that drill bits constructed as above described and illustrated provide considerably improved drilling rates as compared with conventional forms of drill bit having standard substantially symmetrically bevelled inserts and tested under similar conditions.

What we claim is:

1. A rotary percussive drill bit comprising a body having a longitudinal axis, a side face and an end face; cutting inserts mounted in the body and projecting axially forwardly from the end face; each insert having a substantially flat leading face which lies substantially in a plane extending parallel to the longitudinal axis to provide a substantially zero rake angle, all such leading faces being similarly oriented to face towards the intended direction of rotation of the bit; and wherein each said leading face projects axially forwardly of the body end face to communicate at a leading cutting edge with a clearance face of its insert, which clearance face extends substantially transversely of the bit and is substantially flat to provide a substantially straight leading cutting edge on its respective insert, the arrangement being such that during rotary percussive drilling wear tends to take place over the clearance face and thus the leading cutting edge tends to be preserved, and wherein the leading cutting edge of at least one insert extends radially outwardly beyond the side face of the bit body for providing clearance cutting.

2. A rotary percussive drill bit as claimed in either claim 1 wherein a first angle is formed between the leading face and the clearance face and such first angle is acute on at least one cutting insert.

3. A rotary percussive drill bit as claimed in claim 3 wherein the first angle is in the range 80° to 87°.

4. A rotary percussive drill bit as claimed in claim 3 wherein the first angle is substantially 83°.

5. A rotary percussive drill bit as claimed in claim 1 wherein at least one of the cutting inserts is provided with a trailing face which extends fromt the clearance face on the side thereof remote from the leading face or its respective insert, such trailing face forming, upon its notional extension, a second acute angle with the leading face.

6. A rotary percussive drill bit as claimed in claim 5 wherein a first angle is formed between the leading face and the clearance face and said first angle is acute on at least one cutting insert, and the second acute angle is less than the first acute angle on its respective insert.

7. A rotary percussive drill bit as claimed in claim 5 wherein the second acute angle lies in the range 50° to 80°.

8. A rotary percussive drill bit as claimed in claim 7 wherein the second acute angle is substantially 55°.

9. A rotary percussive drill bit as claimed in claim 5 wherein the trailing face extends to the body end face and the latter is shaped locally to present a substantially smooth surface with the trailing face.

10. A rotary percussive drill bit as claimed in claim 1 wherein the leading faces project axially forwardly of the body end face to a distance in the range 0.1 to 0.5 centimeters.

11. A rotary percussive drill bit as claimed in claim 1 wherein the leading cutting edges are located to lie in a common plane which extends substantially perpendicularly to the longitudinal axis of the body.

12. A rotary percussive drill bit as claimed in claim 1 wherein the leading cutting edge of at least one of the inserts lies substantially in a plane which extends parallel to and includes the longitudinal axis.

13. A rotary percussive drill bit as claimed in claim 1 wherein the leading cutting edge of at least one of the inserts is arranged so that, with the position at which the radially outer end of the leading cutting edge, or the notional extension of the leading cutting edge, intersects the peripheral edge of the end face lying in a notional plane which is parallel to and includes the longitudinal axis, the leading cutting edge forms a third acute angle with such notional plane so that the radially inner part length of the leading cutting edge leads the radially outer end of the leading cutting edge during rotation of the drill bit in the intended direction of drilling.

14. A rotary percussive drill bit as claimed in claim 13 wherein the third acute angle formed between the leading cutting edge and the notional plane is in the range 5° to 30°.

15. A rotary percussive drill bit as claimed in claim 14 wherein the third acute angle is substantially 10°.

16. A rotary percussive drill bit as claimed in claim 1 wherein the leading cutting edge of at least one of the inserts is arranged so that, with the position at which the radially outer end of the leading cutting edge, intersects the peripheral edge of the end face lying in a notional plane which is parallel to and includes the longitudinal axis, the leading cutting edge forms a fourth acute angle with such notional plane so that the radially outer end of the leading cutting edge leads the radially inner part length of the leading cutting edge during rotation of the drill bit in the intended direction of drilling.

17. A rotary percussive drill bit as claimed in claim 16 wherein the fourth acute angle formed between the leading cutting edge and the notional plane is in the range 5° to 30°.

18. A rotary percussive drill bit as claimed in claim 17 wherein the fourth acute angle is substantially 10°.

19. A rotary percussive drill bit as claimed in claim 1 wherein the leading face of at least one of the inserts constitutes part of a substantially full side face of its insert.

20. A rotary percussive drill bit as claimed in claim 1 wherein the leading face of at least one of the inserts partially defines a rebate in its insert.

21. A rotary percussive drill bit as claimed in claim 20 wherein the rebate extends axially below the end face of the bit body.

22. A rotary percussive drill bit as claimed in claim 1 wherein at least one of the inserts is positioned so that a portion of the leading face of that insert extends radially outwardly beyond the side face of the bit body, such portion of the leading face forming with a radially outer side face of its insert a longitudinally extending, substantially straight, clearance cutting edge which is located radially outwardly of the side face of the bit body for providing clearance cutting for the bit body.

23. A rotary percussive drill bit as claimed in claim 22 wherein the leading cutting edge and clearance cutting edge communicate with each other through a bevelled or an arcuate edge portion to alleviate breakage of the insert at a corner which may otherwise be formed at the junction of such cutting edges.

24. A rotary percussive drill bit as claimed in claim 22 wherein with the leading cutting edge of an insert substantially located in a plane which extends perpendicular to the longitudinal axis, the clearance cutting edge of that insert converges with said plane at a fifth acute angle.

25. A rotary percussive drill bit as claimed in claim 24 wherein the fifth acute angle is in the range 80° to 89°.

26. A rotary percussive drill bit as claimed in claim 25 wherein the fifth acute angle is substantially 87°.

27. A rotary percussive drill bit as claimed in claim 22 wherein the radially outer side face of the insert is substantially flat and converges from the clearance cutting edge to the side face of the bit body to present a substantially smooth surface therewith.

28. A rotary percussive drill bit as claimed in claim 1 and having cutting inserts of elongate form which are mounted in the bit body so that their major dimensions extend generally radially relative to the longitudinal axis of the body.

29. A rotary percussive drill bit as claimed in claim 28 wherein the cutting inserts are located on the bit body to extend generally radially in radially extending wing portions of said body.

30. A rotary percussion drill bit as claimed in claim 1 wherein the bit body has an internal passage communicating with at least one opening and through which flushing fluid may be passed to aid removal of detritus from the end face during use of the bit.

31. A rotary percussion drill bit as claimed in claim 30 wherein a said opening is located substantially centrally of the end face and the cutting inserts are disposed substantially symmetrically around the central opening.

* * * * *